US011248357B1

(12) United States Patent
Finlayson

(10) Patent No.: US 11,248,357 B1
(45) Date of Patent: Feb. 15, 2022

(54) HIGH DENSITY FLUID RECOVERY OF SUNKEN MATERIAL

(71) Applicant: SYNCRUDE CANADA LTD. in trust for the owners of the Syncrude Project as such owners exist now and in the future, Calgary (CA)

(72) Inventor: Trevor Finlayson, Fort McMurray (CA)

(73) Assignee: Syncrude Canada Ltd. in Trust for the Owners of the Syncrude Project as such owners exist now and in the future, Calgary (CA)

( * ) Notice: Subject to any disclaimer, the term of this patent is extended or adjusted under 35 U.S.C. 154(b) by 0 days.

(21) Appl. No.: 16/994,250

(22) Filed: Aug. 14, 2020

(51) Int. Cl.
*E02B 15/08* (2006.01)
*E02B 15/04* (2006.01)
*E02B 15/06* (2006.01)

(52) U.S. Cl.
CPC ..... *E02B 15/0857* (2013.01); *E02B 15/048* (2013.01); *E02B 15/06* (2013.01)

(58) Field of Classification Search
CPC ..... E02B 15/04; E02B 15/048; E02B 15/06; E02B 15/0814; E02B 15/0857; E02B 43/122; E02B 43/36
See application file for complete search history.

(56) References Cited

U.S. PATENT DOCUMENTS 3,681,923 A * 8/1972 Hyde ..... E21B 43/0122 405/60
5,215,407 A * 6/1993 Brelsford ..... E02B 15/041 405/63
8,517,632 B2 * 8/2013 Later ..... E21B 43/0122 405/60
2005/0025574 A1 * 2/2005 Lazes ..... B63C 7/006 405/60
2008/0135494 A1 * 6/2008 Usher ..... B63B 35/32 210/747.6
2012/0138539 A1 * 6/2012 Cogliandro ..... C02F 1/681 210/695
2012/0155964 A1 * 6/2012 Carter ..... E21B 43/0122 405/60
2012/0181041 A1 * 7/2012 Willman ..... E21C 50/02 166/357
2013/0046126 A1 * 2/2013 Varney ..... E21B 43/0122 588/260
2013/0108369 A1 * 5/2013 Splittstoesser ..... E21B 43/0122 405/63
2013/0129421 A1 * 5/2013 Belzile ..... E02B 15/0807 405/63
2014/0216753 A1 * 8/2014 Smith ..... E21B 43/124 166/372
2014/0356069 A1 * 12/2014 Gateff ..... B66D 1/60 405/60
2015/0197906 A1 * 7/2015 Denning ..... E02B 15/04 405/64

(Continued)

*Primary Examiner* — Benjamin F Fiorello
(74) *Attorney, Agent, or Firm* — Bennett Jones LLP

(57) ABSTRACT

A method for recovering a sunken material from a body of water having a water layer and a sediment layer, the sunken material present at a water-sediment interface is presented, comprising using an impermeable hollow column and a high density fluid to float the sunken material to the top of the column for readily removal of the floated sunken material using surface material removing equipment.

20 Claims, 1 Drawing Sheet

(56) References Cited

U.S. PATENT DOCUMENTS

| | | | | |
|---|---|---|---|---|
| 2015/0211340 | A1* | 7/2015 | Vu | E02B 15/046 405/64 |
| 2015/0226039 | A1* | 8/2015 | Vu | E21B 43/0122 405/64 |
| 2015/0240604 | A1* | 8/2015 | Vu | E21B 43/0122 405/64 |
| 2015/0240605 | A1* | 8/2015 | Vu | E21B 43/0122 405/64 |
| 2016/0333674 | A1* | 11/2016 | Anderson | E02B 15/08 |

* cited by examiner

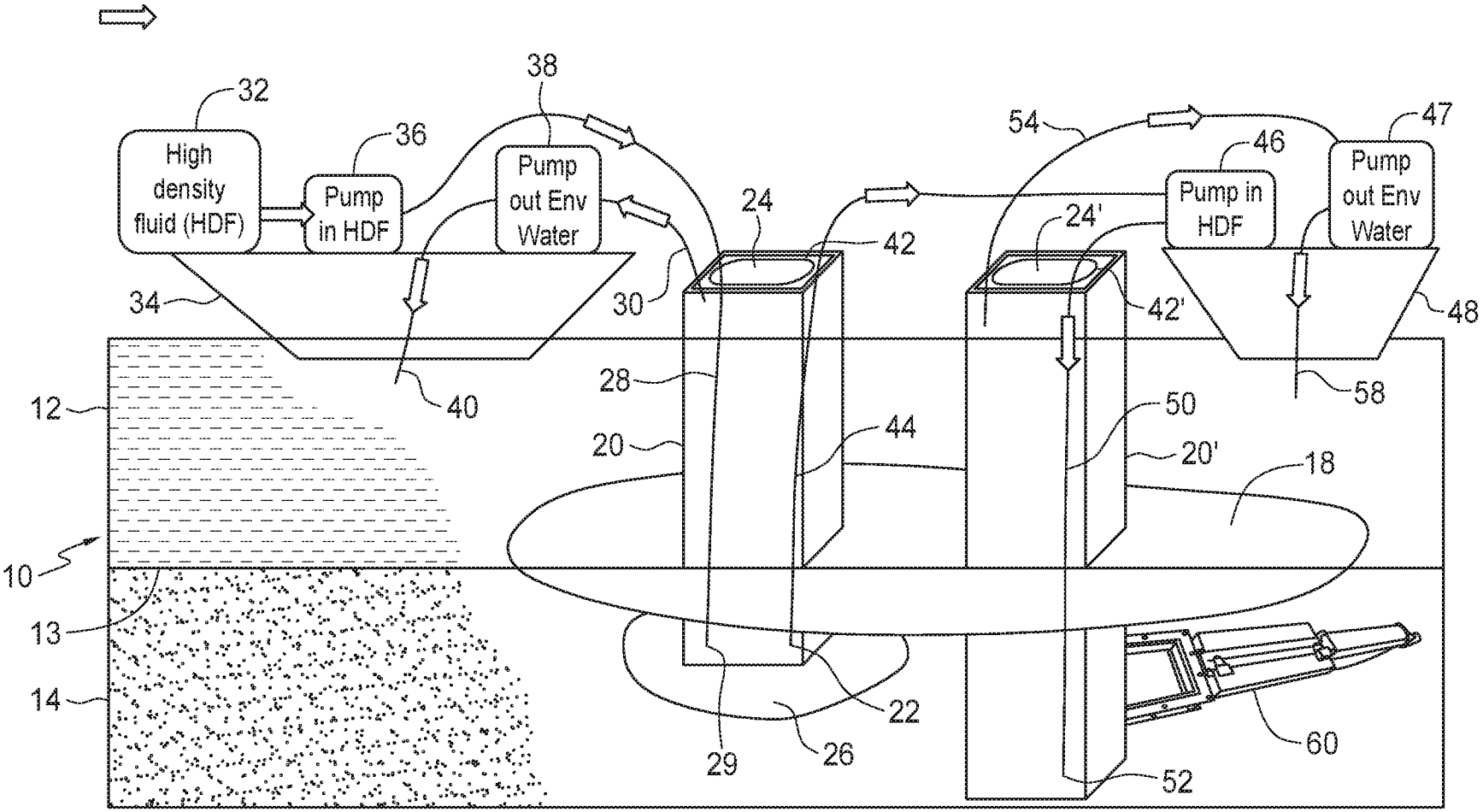
Pump out Env Water
Pump in HDF
Pump out Env Water
Pump in HDF
High density fluid (HDF)
47
48
58
46
18
60
50
20'
42'
24'
52
54
42
44
22
26
24
29
30
28
20
38
40
36
32
34
12
10
13
14

HIGH DENSITY FLUID RECOVERY OF SUNKEN MATERIAL

FIELD OF THE INVENTION

The present invention relates to an apparatus and method for recovering sunken material such as hydrocarbon or bitumen from a body of water using high density fluid recovery. More particularly, sunken hydrocarbon or bitumen from oil spills, oil sands pit lakes and the like is recovered by using a high density fluid to float the sunken material to the top of the body of water.

BACKGROUND OF THE INVENTION

Sunken hydrocarbon or bitumen present in bodies of water is much harder to recover than the relatively simple challenge of recovering hydrocarbon or bitumen from the surface of the body of water. It is far more technically complex, and expensive, than putting out booms and skimming floating oil. Currently, there isn't a single preferred method for the removal of sunken hydrocarbon or bitumen from a water body that is efficient and does not impact the surrounding sediments and environment.

The existence of sunken bitumen in oil sands pit lakes poses a significant risk to the ability to successfully reclaim and certify such pit lakes. Pit lakes can be used to reclaim fluid fine tailings that are produced as a result of the extraction of bitumen from oil sands using hot water processes. The fluid fine tailings behave as a fluid colloidal-like material and, thus, have very slow consolidation rates. One way to reclaim fluid fine tailings is to deposit them below grade into a pit and add a layer of water of sufficient depth and volume to create a relatively shallow lake in the closure landscape. However, because these fluid fine tailings still contain a small amount of bitumen, sunken bitumen can exist at the interface between the water and the fluid fine tailings. It is necessary to remove this sunken bitumen with as little disturbance as possible of the fluid fine tailings so that these pit lakes can be reclaimed.

Current methods for removal of sunken bitumen in pit lakes is accomplished via mechanical dredging (e.g., excavator and clam shell bucket) or hydraulic dredging (e.g., cutter suction dredge) with mixed success. Conventional sunken oil cleanup operations also utilize mechanical and hydraulic dredging, and, in addition, will routinely drag absorbent materials through the sunken oil to facilitate its removal. All methods described above will have a significant impact on the lake bottom sediments and can create additional turbidity of the water column.

There is a need in the industry for an efficient, low impact method to remove sunken hydrocarbon or bitumen from a body of water.

SUMMARY OF THE INVENTION

The present application relates to an apparatus and method for recovering sunken material, e.g., hydrocarbon and bitumen, from a water body through high density fluid recovery. Common high density fluids include but is not limited to brine, fluid fine tailings, drilling mud, and the like.

It was discovered by the present applicant that, in pit lakes, bitumen is present at the fluid fine tailings/water interface as mats that were generated from bitumen that was liberated when the fluid fine tailings were initially deposited. In addition to pit lakes, newly reclaimed wetlands/lowlands may exhibit residual sunken bitumen in the reclaimed landscape. Isolating these areas and applying the present invention may prove to minimize the impact on the reclaimed surface as opposed to excavating the targeted area with large construction equipment.

In one aspect, a method for recovering a sunken material from a body of water having a water layer and a sediment layer, the sunken material present at a water-sediment interface, is provided, comprising:

- inserting an impermeable hollow column vertically into the body of water and through the sunken material such that a top of the column is exposed to the atmosphere and a bottom of the column is embedded into the sediment layer;
- removing water present in the column at or near the top of the column while simultaneously injecting a high density fluid at or near the bottom of the column to float the sunken material to the top of the column; and
- removing floated sunken material using surface material removing equipment.

In one embodiment, the surface material moving equipment includes a skimmer, a rake, and a vacuum. In one embodiment, the sunken material is hydrocarbon from an oil spill. In another embodiment, the sunken material is bitumen present in a pit lake.

In one embodiment, the impermeable hollow column is made from metal, plastic or a combination of both. In one embodiment, the impermeable hollow column comprises a skirt at the bottom of the column. In one embodiment, the skirt is made from a flexible material including rubber to aid in the formation of a seal to prevent the loss of the high density liquid from the bottom of the column.

In one embodiment, the high density fluid is selected from the group consisting of brine, fluid fine tailings and drilling mud. In one embodiment, the sunken material is bitumen and the high density liquid has a density greater than the density of the bitumen. In one embodiment, the sunken material is hydrocarbon and the high density liquid has a density greater than the density of the hydrocarbon.

In another aspect, a method for recovering a sunken material from a body of water having a water layer and a sediment layer, the sunken material present at a water-sediment interface, is provided, comprising:

- inserting an impermeable hollow column vertically into the body of water and through the sunken material such that a top of the column is exposed to the atmosphere and a bottom of the column is embedded into the sediment layer;
- adding an amount of dry chemical to the column sufficient to produce a high density fluid and float the sunken material to the top of the column; and
- removing floated sunken material using surface material removing equipment.

In one embodiment, the surface material moving equipment includes a skimmer, a rake, and a vacuum. In one embodiment, the sunken material is hydrocarbon from an oil spill. In another embodiment, the sunken material is bitumen present in a pit lake. In another embodiment, the dry chemical is a salt, a polymer, a colloidal forming material, or combinations thereof.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein:

FIG. 1 is a schematic of the high density fluid recovery method and apparatus for recovering sunken bitumen from a body of water.

DETAILED DESCRIPTION OF THE PREFERRED EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The present invention relates generally to a method and apparatus for recovering sunken material such as hydrocarbons/bitumen in bodies of water by using a high density fluid. As used herein, the term "high density fluid" means any fluid having a density greater than the sunken material being recovered. For example, if the material being recovered is bitumen, then the high density fluid must have a density greater than 1.012 ($kg/m^3$) at atmospheric conditions. Useful high density materials include brine, fluid fine tailings, drilling mud and the like.

As used herein, "fluid fine tailings" is a liquid suspension of oil sand fines in water with a solids content greater than 2%. "Fines" are mineral solids with a particle size equal to or less than 44μ. In addition to fines, fluid fine tailings contain water, minor amounts of sand and silt, and residual bitumen.

As used herein, "sunken material" means any material that is present below the surface of a body of water, such as hydrocarbon or bitumen, which is generally found at the bottom of the water column, i.e., at the water/sediment interface.

With reference now to FIG. 1, a body of water 10 is shown comprising an upper water layer 12 and a lower sediment layer 14. At the interface 13 of the water layer 12 and the sediment layer 14 is sunken material 18 (e.g., bitumen). A first impermeable hollow column 20, which column could be cylindrical, square, etc. and made from any rigid material capable of forming a hollow column such as metal, plastic, a combination thereof, etc., is inserted vertically into the body of water 10 and through the sunken material 18, ensuring that the bottom 22 of column 20 fully penetrates sunken material 18. The bottom 22 of column 18 is then further extended into the water body sediment layer 14 to form a seal in the sediment layer 14. The top 24 of column 20 extends above the body of water 10 surface to prevent the overflowing of column 20 by waves, etc., but is positioned low enough such that the sunken material therein can be readily removed.

A high density fluid discharge pipe 28 is inserted into column 20 through the sunken material 18 and the bottom end 29 of pipe 28 is positioned at or near the bottom 22 of column 20. A suction line 30 is also inserted at or near the top 24 of column 20. In operation, environmental water from body of water 10 that is present in column 20 is pumped from column 20 via pump 38, which may be positioned on boat 34, while simultaneously pumping a high density fluid such as brine, which may be housed in a tank 32 positioned on boat 34, via pump 36 through high density fluid discharge pipe 28 to the bottom of column 20. In one embodiment, a diffuser head (not shown) may be used on the bottom end 29 of high density fluid discharge pipe 28 to prevent disturbance of the sunken product and underlying sediment. The environmental water that is pumped from column 20 is then reintroduced into body of water 10 via line 40. The volumes of extracted environmental water and high density input fluid are both monitored.

The high density fluid displaces the environmental water present in column 20, along with the sunken material 18 that is also present in column 20, such that the sunken bitumen 18 floats to the top 24 of column 20. Floated sunken material 42 can now be removed via skimmer, vacuum, overflow, rack, etc. or allowed to overflow from the column 20 to a catchment rim (not shown) around the column or any other method of surface removal. If additional areas of the water body 10 need to be remediated of sunken material, the column can be drained of the high density fluid into a storage container (not shown), lifted, relocated, and reset through the body of water 10. The process then is repeated until remediation is complete.

In one embodiment, bottom 22 of column 20 is fitted with an impermeable skirt 26, for example, a skirt made of rubber, to help minimize the loss of high density fluid. It is understood that the skirt could be made of any flexible impermeable material that is able to conform to the bottom (sediment) of the body of water, thereby creating a seal. In one embodiment, the skirt would be weighted to create the seal between the bottom and the impermeable column to help prevent the loss of the high density fluid.

In one embodiment, instead of pumping high density fluid into a column, a dry chemical such as a salt (e.g., NaCl, KCl, $CaCl_2$), a polymer, a colloidal forming material (e.g., bentonite, illite, kaolinite, smectite), etc. can be added to the environmental water within the column to create the high density fluid in-situ. Slight agitation may be required to liberate the sunken material from the underlying sediment.

In one embodiment, a second impermeable hollow column 20' is inserted vertically into the body of water 10 and through the sunken material 18, ensuring that the bottom 22' of column 20' fully penetrates sunken material 18. High density fluid present in column 20 can be pump through high density fluid pipe 44, which is positioned at or near the bottom 22 of column 20, via pump 46 positioned on a second boat 48, into high density fluid discharge pipe 50, which is inserted into column 20' through the sunken material 18. The bottom end 52 of pipe 50 is positioned at or near the bottom 22' of column 20'. A suction line 54 is inserted at or near the top 24' of column 20'. In operation, environmental water from body of water 10 that is present in column 20' is pumped from column 20' through suction line 54 via pump 47, which may be positioned on boat 48, while simultaneously pumping the high density fluid present in column 20 into column 20'. The environmental water that is pumped from column 20' is then reintroduced into body of water 10 via line 58. The bottom 22' of column 20' can be fitted with an impermeable (rubber, etc.) skirt to help minimize the loss of high density fluids, as in column 20, or column 20' could also be fitted with a gate valve 60 to seal the base once it is in place to ensure minimum loss of high density fluids into environmentally sensitive areas.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a method for recovering a sunken material from a body of water having a water layer and a sediment layer, the sunken material present at a water-sediment interface, comprising inserting an impermeable hollow column vertically into the body of water and through the sunken material such that a top of the column is exposed to the atmosphere and a bottom of the column is embedded into the sediment layer; removing water present in the column at or near the top of the column while simultaneously injecting a high density fluid at or near the bottom of the column to float the sunken material to the top of the column; and removing floated sunken material using surface material removing equipment.

Clause 2, the method of clause 1, wherein the surface material moving equipment includes a skimmer, a rake, and a vacuum.

Clause 3, the method of clause 1, wherein the sunken material is hydrocarbon from an oil spill.

Clause 4, the method of clause 1, wherein the sunken material is bitumen present in a pit lake.

Clause 5, the method of clause 1, wherein the impermeable hollow column is made from metal, plastic or a combination of both.

Clause 6, the method of clause 1, wherein the impermeable hollow column comprises a skirt at the bottom of the column.

Clause 7, the method of clause 6, wherein the skirt is made from a flexible material including rubber to aid in the formation of a seal to prevent the loss of the high density liquid from the bottom of the column.

Clause 8, the method of clause 1, wherein the high density fluid is selected from the group consisting of brine, fluid fine tailings and drilling mud.

Clause 9, the method of clause 1, wherein the sunken material is bitumen and the high density liquid has a density greater than the density of the bitumen.

Clause 10, the method of clause 1, wherein the sunken material is hydrocarbon and the high density liquid has a density greater than the density of the hydrocarbon.

Clause 11, a method for recovering a sunken material from a body of water having a water layer and a sediment layer, the sunken material present at a water-sediment interface, comprising inserting an impermeable hollow column vertically into the body of water and through the sunken material such that a top of the column is exposed to the atmosphere and a bottom of the column is embedded into the sediment layer; adding an amount of dry chemical to the column sufficient to produce a high density fluid and float the sunken material to the top of the column; and removing floated sunken material using surface material removing equipment.

Clause 12, the method of clause 11, wherein the surface material moving equipment includes a skimmer, a rake, and a vacuum.

Clause 13, the method of clause 11, wherein the sunken material is hydrocarbon from an oil spill.

Clause 14, the method of clause 11, wherein the sunken material is bitumen present in a pit lake.

Clause 15, the method of clause 11, wherein the impermeable hollow column is made from metal, plastic or a combination of both.

Clause 16, the method of clause 11, wherein the impermeable hollow column comprises a skirt at the bottom of the column.

Clause 17, the method of clause 16, wherein the skirt is made from a flexible material including rubber to aid in the formation of a seal to prevent the loss of the high density liquid from the bottom of the column.

Clause 18, the method of clause 11, wherein the high density fluid is selected from the group consisting of brine, fluid fine tailings and drilling mud.

Clause 19, the method of clause 11, wherein the sunken material is bitumen and the high density liquid has a density greater than the density of the bitumen.

Clause 20, the method of clause 11, wherein the sunken material is hydrocarbon and the high density liquid has a density greater than the hydrocarbon.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

What is claimed:

1. A method for recovering a sunken material from a body of water having a water layer and a sediment layer, the sunken material present at a water-sediment interface, comprising:

inserting an impermeable hollow column vertically into the body of water and through the sunken material such that a top of the column is exposed to the atmosphere and a bottom of the column is embedded into the sediment layer;

removing water present in the column at or near the top of the column while simultaneously injecting a high density fluid at or near the bottom of the column to float the sunken material to the top of the column; and removing floated sunken material using surface material removing equipment.

2. The method as claimed in claim 1, wherein the surface material moving equipment includes a skimmer, a rake, and a vacuum.

3. The method as claimed in claim 1, wherein the sunken material is hydrocarbon from an oil spill.

4. The method as claimed in claim 1, wherein the sunken material is bitumen present in a pit lake.

5. The method as claimed in claim 1, wherein the impermeable hollow column is made from metal, plastic or a combination of both.

6. The method as claimed in claim 1, wherein the impermeable hollow column comprises a skirt at the bottom of the column.

7. The method as claimed in claim 6, wherein the skirt is made from a flexible material including rubber to aid in the formation of a seal to prevent the loss of the high density liquid from the bottom of the column.

8. The method as claimed in claim 1, wherein the high density fluid is selected from the group consisting of brine, fluid fine tailings and drilling mud.

9. The method as claimed in claim 1, wherein the sunken material is bitumen and the high density liquid has a density greater than the density of the bitumen.

10. The method as claimed in claim 1, wherein the sunken material is hydrocarbon and the high density liquid has a density greater than the density of the hydrocarbon.

11. A method for recovering a sunken material from a body of water having a water layer and a sediment layer, the sunken material present at a water-sediment interface, comprising:

inserting an impermeable hollow column vertically into the body of water and through the sunken material such that a top of the column is exposed to the atmosphere and a bottom of the column is embedded into the sediment layer;

adding an amount of dry chemical to the column sufficient to produce a high density fluid and float the sunken material to the top of the column; and removing floated sunken material using surface material removing equipment.

12. The method as claimed in claim 11, wherein the surface material moving equipment includes a skimmer, a rake, and a vacuum.

13. The method as claimed in claim 11, wherein the sunken material is hydrocarbon from an oil spill.

14. The method as claimed in claim 11, wherein the sunken material is bitumen present in a pit lake.

15. The method as claimed in claim 11, wherein the impermeable hollow column is made from metal, plastic or a combination of both.

16. The method as claimed in claim 11, wherein the impermeable hollow column comprises a skirt at the bottom of the column.

17. The method as claimed in claim 16, wherein the skirt is made from a flexible material including rubber to aid in the formation of a seal to prevent the loss of the high density liquid from the bottom of the column.

18. The method as claimed in claim 11, wherein the high density fluid is selected from the group consisting of brine, fluid fine tailings and drilling mud.

19. The method as claimed in claim 11, wherein the sunken material is bitumen and the high density liquid has a density greater than the density of the bitumen.

20. The method as claimed in claim 11, wherein the sunken material is hydrocarbon and the high density liquid has a density greater than the hydrocarbon.

* * * * *